US007234254B2

(12) United States Patent
Schmidt

(10) Patent No.: US 7,234,254 B2
(45) Date of Patent: Jun. 26, 2007

(54) BOTTLE RACK RETAINER LEASH

(76) Inventor: Edmund Schmidt, 1214 Cambridge St., Novato, CA (US) 94947

( * ) Notice: Subject to any disclaimer, the term of this patent is extended or adjusted under 35 U.S.C. 154(b) by 179 days.

(21) Appl. No.: 11/139,154

(22) Filed: May 27, 2005

(65) Prior Publication Data

US 2005/0263471 A1 Dec. 1, 2005

Related U.S. Application Data

(60) Provisional application No. 60/574,792, filed on May 27, 2004.

(51) Int. Cl.
*G09F 3/00* (2006.01)

(52) U.S. Cl. ..... 40/310; 211/74

(58) Field of Classification Search ..... 40/310; 224/148.6, 251, 250, 254; 211/74
See application file for complete search history.

(56) References Cited

U.S. PATENT DOCUMENTS 2,269,471 A * 1/1942 Mucndel ..... 108/161
5,147,079 A * 9/1992 Heather ..... 224/148.6
5,409,151 A * 4/1995 Freimark ..... 224/148.6
5,613,657 A * 3/1997 Olaiz ..... 248/102
6,401,993 B1 * 6/2002 Andrino ..... 224/148.5
6,443,338 B1 * 9/2002 Giacona, III ..... 224/148.6
6,626,333 B2 * 9/2003 Levesque et al. ..... 224/148.6
2003/0111496 A1 * 6/2003 Abbott ..... 224/148.6
2003/0226298 A1 * 12/2003 Bjork ..... 40/310
2004/0104187 A1 * 6/2004 McCain ..... 211/75
2006/0207132 A1 * 9/2006 Vaughan et al. ..... 40/310

* cited by examiner

*Primary Examiner*—Gary C. Hoge
(74) *Attorney, Agent, or Firm*—Craig M. Stainbrook; Stainbrook & Stainbrook, LLP

(57) ABSTRACT

A seismic anchoring system to prevent damage to wine bottles during earthquakes, including a resilient leash having a ring on a free end and connected at its other end to or proximate to a holding bin. In use, the ring is disposed over the neck of a bottle in a bottle holding bin and thus prevents excursion of the bottle from the bin. The leash further provides means for displaying bottle content information.

1 Claim, 2 Drawing Sheets

BOTTLE RACK RETAINER LEASH

CROSS REFERENCE TO RELATED APPLICATIONS

The present application claims the benefit of the filing date of U.S. Provisional Patent Application Ser. No. 60/574,792, filed May 27, 2004 (May 27, 2004).

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to seismic anchoring systems, and more particularly to seismic restraints for small articles, and still more particularly to a method and apparatus for securing wine bottles in a wine rack.

BACKGROUND INFORMATION AND DISCUSSION OF RELATED ART

It is well known to protect articles and equipment from earthquake damage by using seismic anchoring devices, tie-downs, hold-downs, mooring apparatus, displacement limiting devices, and the like. In fact, the prior art is so replete with seismic protection devices that it would require volumes simply to catalogue them all. Many are directed to reinforcing and securing structures and providing increased structural support for expensive material, equipment, and furnishings, or to prevent structural damage from structural mechanical damage (seismic straps for securing water heaters, for example). A few prior art devices are illustrative of art in field analogous to that of the present invention. Among them:

U.S. Pat. No. 6,349,906 to Anderson, discloses an earthquake-proof beverage bottle support and storage structure adapted to be fastened to a building wall, or other support structure, for securing a bottled beverage container holder and dispenser above a floor, including a shelf for supporting a bottled beverage container holder and dispenser, at least three legs secured to the shelf extending above and below the shelf for supporting the shelf above a floor, and straps with interlocking buckles for securing the beverage bottle to the support system to restrict horizontal movement between the shelf and the beverage bottle. The entire structure can be secured to a wall, or other support structure, by fasteners, or additional straps. Additional shelves and straps can be added to provide storage for additional bottles, whether full or empty.

U.S. Pat. No. 6,050,538 to Marrow et al., teaches a restraint system and method for protecting at wine barrels in a barrel stack against earthquake damage. The stack includes a plurality of modules and each of the modules has a top rack, at least one intermediate rack and a bottom rack and at least one barrel on each of the racks. The barrel restraint system comprises a restraining mechanism operably engaged to at least the top barrels in the module at the top of the barrel stack for restraining the top barrels within the top module. Typically each module contains at least two barrels and the restraining means restrains all of the top barrels, because by restraining all of the top barrels and only the top barrels within the top module, the top barrels will be protected from being ejected from the top rack. All of the remaining barrels in the intermediate and bottom racks may be protected without the use of the restraining means due to the overburden weight of the barrels stacked above.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

The present invention is an anchoring system directed to preventing wine bottle breakage during earthquakes. In its most essential aspect, the system can be understood as a seismic anchoring system, a tie down apparatus, a hold down bracket, a seismic isolation device, a displacement control device, and/or a mooring apparatus. It comprises a partially resilient leash which has a ring on a free end and which is connected at its other end to or proximate to a holding bin. To accomplish its purpose, the ring is disposed over the neck of a bottle in a bottle bin, generally in a wine rack. When used in this manner the leash restricts movement of the wine bottle and prohibits excursion of the bottle from the bin. The leash also provides a convenient means to display bottle identifying placards or tags so that a long-cellared bottle need not be disturbed when determining its contents.

It is therefore an object of the present invention to provide a new and improved wine bottle seismic anchoring system.

Another object of the present invention is to provide an economical system for anchoring wine bottles, in which individual restraints are inexpensive to provide and to replace and A further object or feature of the present invention is a new and improved wine bottle anchoring system that facilitates bottle identification.

An even further object of the present invention is to provide an aesthetically appealing wine bottle seismic anchoring apparatus that easily incorporates elegant design features complementary to fine wines.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
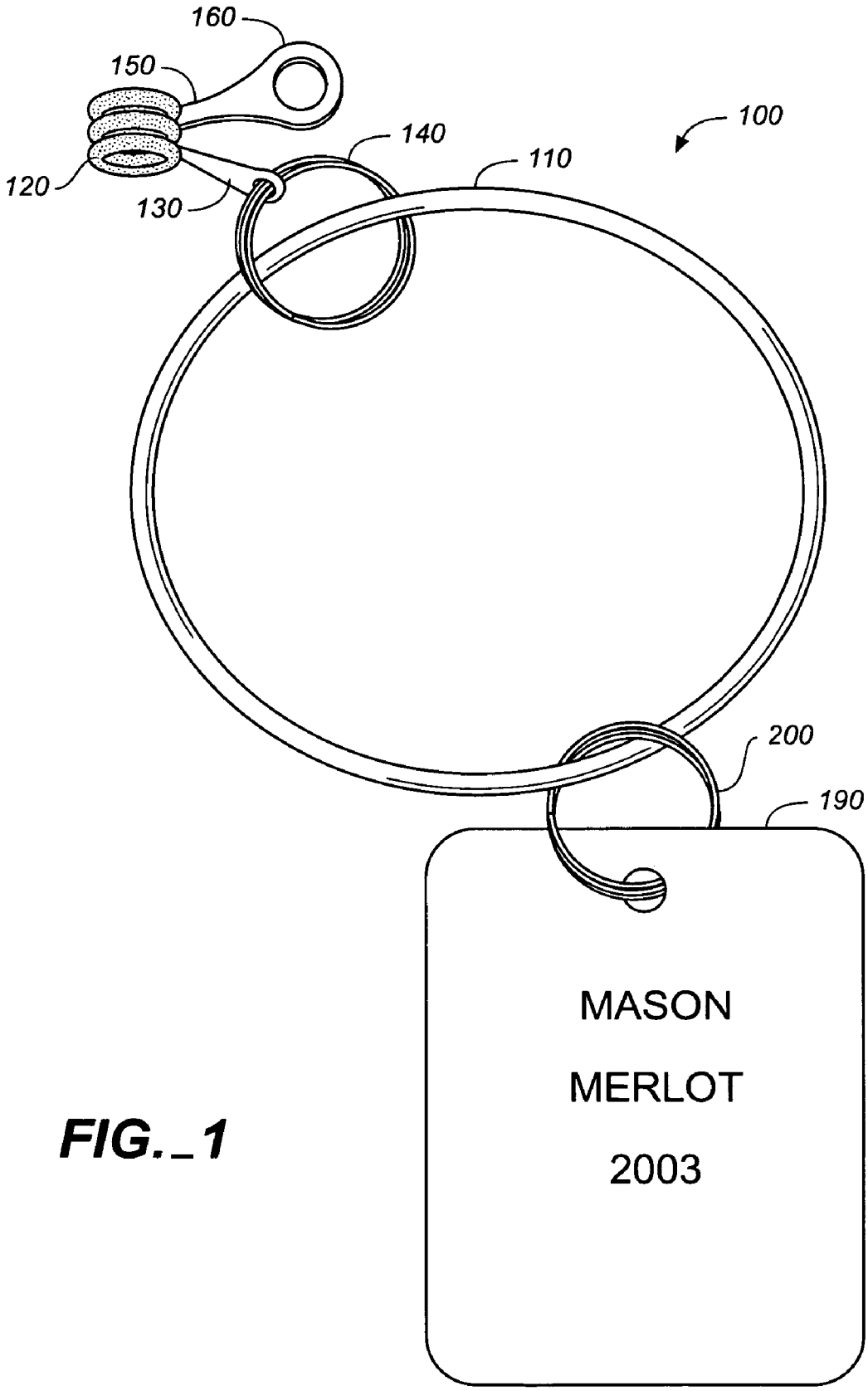
FIG. 1 is a perspective view of the bottle rack retainer leash of the present invention.
Figure 2:
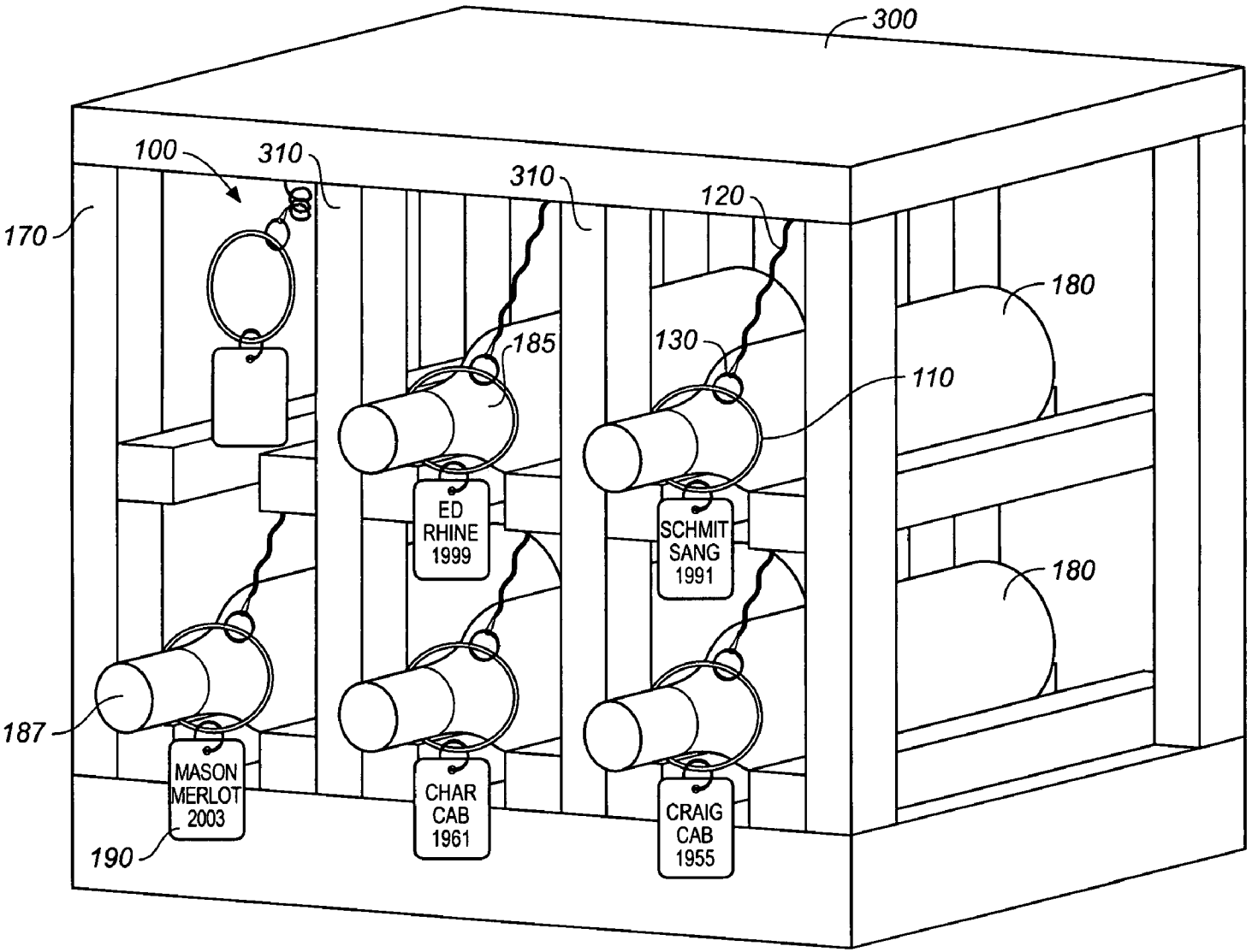
FIG. 2 is a perspective view showing several of the inventive apparatus installed on a wine bottle rack, all but one of which are shown restricting wine bottles from removal or displacement from a holding bin in the rack.

Referring to FIGS. 1 and 2, wherein like reference numerals refer to like components in the various views, there is illustrated therein a new and improved bottle rack retainer leash, generally denominated 100 herein.

FIG. 1 and illustrate a preferred embodiment of the inventive apparatus, showing that the bottle rack retainer leash of the present invention comprises a bottle retention ring 110 to which a cord or leash 120 is connected. The ring is sized with a sufficient diameter to fit easily over the neck of standard wine bottles. The leash is preferably extensible and retractable and/or includes at least a resilient portion which is preferably fabricated from helically wound plastic line, elastic cord, elastic shock cord, braided elastic, rubber band, metal spring and/or the like. At its first end 130 the leash is connected to the bottle retention ring. A leash connection ring 140, such as a key ring, plastic hook, or another slidable connection means, and having a diameter substantially smaller than that of the bottle retention ring, may be interposed between the first end and the bottle retention ring 110 to facilitate movement of the leash along the circumference of the bottle retention ring. Additionally, the first end itself may comprise attachment means in the form of an integral ring or a terminal expansion having a through hole.

At a second end 150 the leash terminates in attachment means 160, such as a tab having a through hole, for fixing the second end to a structural element in a bottle holding bin, such as a frame member 170 as found in a conventional bottle rack.

When used for restraining and protecting wine bottles 180, or other bottles for which long term storage may be called for (and thus where it is undesirable to disturb the bottle during storage), yet where easy bottle identification may be important, it may be desirable to provide a hang tag 190, preferably attached to the bottle retention ring through a tag connection ring 200, also having a diameter substantially smaller than that of the bottle retention ring. When employed to identify wine bottles, such a tag might include, for example, information concerning the vintage, the winery or estate, the varietal, or tasting notes.

FIG. 2 shows how the inventive apparatus may be installed on a conventional wooden wine bottle rack 300. This view shows how when not in use the inventive bottle rack retainer leash 100 hangs freely within a holding bin. However, when employed to restrain a bottle, it will be seen that the bottle retention ring 110 is placed over the neck of a wine bottle 180 and generally rests upon the shoulder of the bottle, and the resilient leash gently urges the bottle inwardly, or toward the interior portion of the bin. The leash thus restricts the bottle from moving out of the bin when the rack is jarred, for instance during a seismic event or inadvertent jostling. Additionally, it provides a small amount of lateral restraint, so that excessive side-to-side movement is also reduced.

Preferably the leash is resilient enough only to allow the neck 185 of the bottle to be inserted through the bottle retention ring and then to be properly seated between the vertical rack supports 310 so that the cork or foil portion 187 of the bottle neck extends outwardly from the vertical supports. However, any further outward movement of the bottle is prevented until the ring is removed.

As will be immediately appreciated by those with skill in the art, the inventive apparatus also provides a novel method of preventing damage to wine bottles during seismic event, the method comprising the steps of: (a) providing a bottle rack retainer leash which includes a leash with a first end and a second end, the first end terminating in a bottle retention ring and the second end having connection means for connecting the second end to a surface on a bottle holding bin, and a resilient portion of cord interposed between the first and second ends; (b) providing a wine rack with one or more holding bins with a front opening and a bottom surface for placing wine bottles in a substantially horizontal disposition such that the neck of the wine bottle is directed toward the opening of the holding bin; (c) connecting the second end of the bottle rack retainer leash to a surface on or proximate the holding bin; and (d) placing the bottle retention ring over the neck of the wine bottle.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A method of preventing damage to wine bottles during seismic event, said method comprising the steps of:

(a) providing a bottle rack retainer leash which includes a leash with a first end and a second end, the first end terminating in a bottle retention ring and the second end having connection means for connecting the second end to a surface on a bottle holding bin, and a resilient portion of cord interposed between the first and second ends;

(b) providing a wine rack with one or more holding bins with a front opening and a bottom surface for placing wine bottles in a substantially horizontal disposition such that the neck of the wine bottle is directed toward the opening of the holding bin;

(c) connecting the second end of the bottle rack retainer leash to a surface on or proximate the holding bin; and (d) placing the bottle retention ring over the neck of the wine bottle.

* * * * *